US006769997B2

(12) United States Patent
Ruiz

(10) Patent No.: US 6,769,997 B2
(45) Date of Patent: Aug. 3, 2004

(54) GOLF PUTTER HEAD

(76) Inventor: Hiram Ruiz, 11 Bailey Dr., Massapequa, NY (US) 11758

( * ) Notice: Subject to any disclaimer, the term of this patent is extended or adjusted under 35 U.S.C. 154(b) by 0 days.

(21) Appl. No.: 10/053,404

(22) Filed: Jan. 16, 2002

(65) Prior Publication Data

US 2003/0134689 A1 Jul. 17, 2003

(51) Int. Cl.[7] ..... A63B 53/04
(52) U.S. Cl. ..... 473/324; 473/328; 473/340
(58) Field of Search ..... 473/324, 327, 473/328, 340, 341, 313, 251; D21/736, 737, 738, 739, 740, 741, 742, 743, 744, 745, 746

(56) References Cited

U.S. PATENT DOCUMENTS 1,541,126 A * 6/1925 Dunn
2,550,846 A * 5/1951 Milligan
D246,541 S * 11/1977 Myers
D262,985 S * 2/1982 Sanna
5,456,464 A * 10/1995 Davenport et al. ..... 473/251
5,467,538 A * 11/1995 Chou et al. ..... 33/508
D397,177 S * 8/1998 Spano
D404,099 S * 1/1999 Mounfield
6,183,380 B1 * 2/2001 Yim ..... 473/330
6,435,979 B1 * 8/2002 Mounfield, Jr. ..... 473/324

* cited by examiner

*Primary Examiner*—Sebastiano Passaniti
(74) *Attorney, Agent, or Firm*—Roger M. Rathbun

(57) ABSTRACT

A golf putter head that minimizes the disruptive contact between the putter head and the surface of the green during the putting stroke. The putter has a front face adapted to strike the ball and which is concavely, upwardly curved so that the center area of the putter face is raised slightly with respect to the outside edges of the club face. In addition, the bottom surface of the putter head is angled upwardly from the front face of the putter head toward the back face to again reduce the possibility of the putter bottom surface contacting the surface of the green. Thus contact with the surface of the green is generally only potentially possible along the front outside edges of the front head that is, at two points.

9 Claims, 1 Drawing Sheet

GOLF PUTTER HEAD

BACKGROUND OF THE INVENTION

The present invention relates to golf clubs and, more particularly, to an improved putter having a specially formed head.

There are, of course, a considerable number of differing types and styles of putters used in playing the game of golf including those with considerable differences in the length of the putter shaft. There are also a wide range or variety of putter heads affixed to such shafts that are intended, one way or the other, to improve the performance of a golfer on the green. In such putters, as will hereinafter be defined, the putter has a front face, that is, the face that strikes the ball in carrying out the putt and, of course, there is a back face that is opposite to the front face. Since the front face is the surface that engages the ball, it is therefore an important surface and its profile is of utmost importance in affecting the path of the ball after being stuck by the putter. As an additional surface of the golf putter, there is, of course, a bottom surface and which is juxtaposed with respect to the surface of the green as the putt is being carried out. As will be seen, that bottom surface is, however also of importance in performing the putt.

One difficulty in current putters, however, is that it is possible, and with many golfers quite common, for the bottom of the putter head to scuff the surface of the green as the putter moves, in a pendulum motion, to strike the ball. Normally, while it is the bottom surface of the putter that scuffs the green surface, it is also the leading edge of the button surface that is most likely to contact the green surface and that contact can obviously affect the performance of the putt since the golfer cannot anticipate that encounter with the green surface. In any event, the contact with or scuffing of the green surface results in a detrimental affect on the length of the putt. If one were to know the amount of such interference with the putting surface, it would be possible to adjust the putting stroke to take that resistance into account and still have a consistent putting stroke, however, the real difficulty lies in the fact that the golfer contacts the surface of the green inconsistently and therefore has no way of automatically making such compensation for the resistance experienced in contacting the surface of the green.

Accordingly, it would be advantageous to have a golf putter that would greatly reduce and minimize the possibility of the bottom surface of the putter encountering the surface of the green in the first place so that the golfer can better judge and anticipate the distance of the putt. As such, it would therefore be preferable to construct a putter head that would minimize the resistance encountered between the putter head and the surface of the green in the event such scuffing takes place so that such advantage can be realized by any golfer using that specially designed putter.

SUMMARY OF THE INVENTION

Therefore, in accordance with the present invention, there is provided a specially constructed putter head that is designed to reduce and minimize the potential of the golfer contacting the surface of the green. However, if such contact is experienced, the present putter head minimizes the effect of such contact and thereby make a putt having a more predictable length.

In the design and construction of the present putter head, the head itself has a front face, a back face and a bottom surface. With the inventive design, the lower edge of the front surface is formed as an upwardly directed arcuate configuration, that is, the center area of the front face is displaced upwardly away from the putting surface of the green as the club is normally utilized. With such arcuate configuration or profile, two outer edges are formed at the ends of the arcuate front face at opposite ends of the front face. In the preferred profile, the lower edge of the front face is a concave surface.

To further reduce the lower surface of the putter that is susceptible to scuffing on the green surface, the bottom surface of the putter head is also angled upwardly from the front face toward the back face, that is, the lower surface of the bottom of the putter slopes upwardly, away from the putting surface in the rearward direction such that the back face of the club has a lower edge that is displaced upwardly with resect to the surface of the putting green as the putter is utilized. By that upwardly sloping surface, the putter head is basically designed so as to only contact the surface of the putting green initially along a two point contact, with those points located at the outer edges of the front face of the putter head.

As can be now seen, in the normal pendulum motion of the swing of the putter, there is a minimum of surface of the putter head that can contact and thus scuff the surface of the green. While the present description has referred to the scuffing taking place in the forward direction of the putter motion, it can be seen that the scuffing can also take place on the back swing of the putter and which can also be extremely disruptive to the normal motion and rhythm desired by the golfer.

Other features of the golf putter head and golf putter will become apparent in light of the following detailed description of a preferred embodiment thereof and as illustrated in the accompanying drawings.

DETAILED DESCRIPTION OF THE INVENTION

Figure 1:
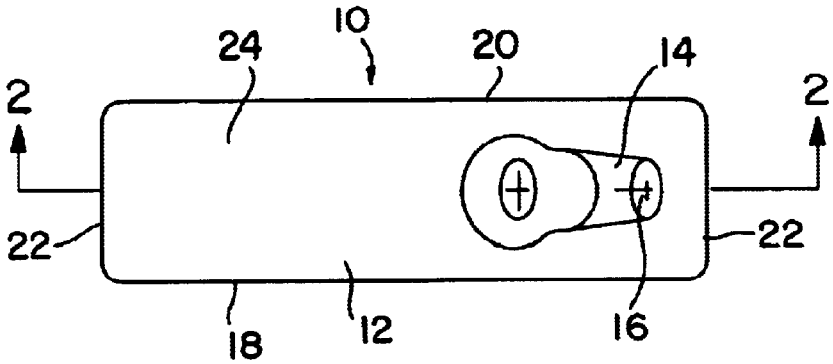
FIG. 1 is a top plan view of the golf putter of the present invention.

Referring now to FIG. 1, there is shown a top plan view of the putter 10 constructed in accordance with the present invention. As can be seen the putter 10 includes a putter head 12 and a hosel 14 extending upwardly therefrom having an opening 16 into which a shaft is adapted to be inserted in forming a completed putter. The putter head 12 includes a front face 18 and a back face 20 along with a pair of side faces 22 and a top surface 24. As shown, the back face 20 of the putter 10 is relatively flat or planar, however, the back face 20 may have a variety of profiles and remain within the scope of the present invention. The same is true of the side faces 22 that, as shown, are generally planar, however, again, the side faces 22 may have a variety of differing configurations and still be consistent with the present invention.

Figure 2:
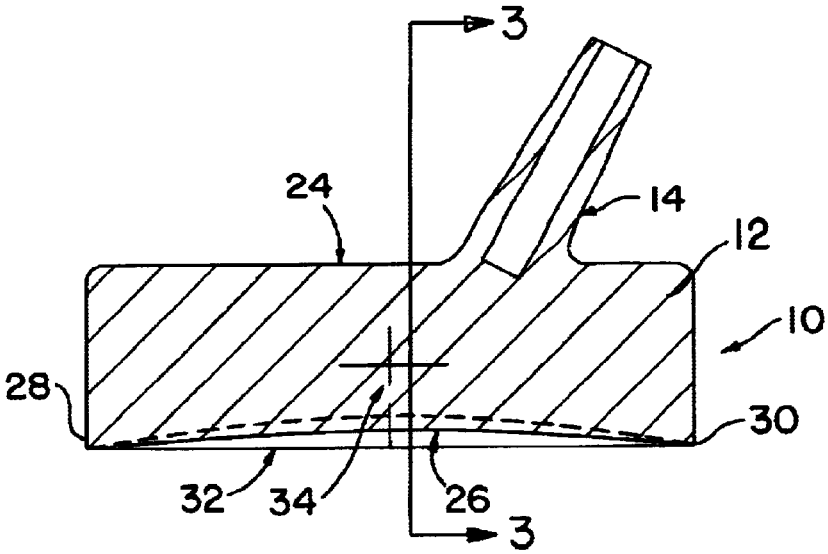
FIG. 2 is a front cross sectional view of the putter constructed in accordance with the present invention taken along the line 2—2 of FIG. 1.

Turning now to FIG. 2, there is shown a front view of the putter 10 taken along the line 2—2 of FIG. 1 and further showing a the hosel 14 that receives and interfits with the lower end of a shaft and the particular angle and location of the hosel 14 may vary according to the design by the maker of the putter and/or the desires of the golfer utilizing the putter 10. In any event, as can be seen in FIG. 2, the bottom surface 26 of the putter 10 is formed in an upwardly arcuate configuration or profile such that the outer edges 28, 30 of the bottom surface 26 of the putter 10 are or approach relatively small points and the arcuate center area of the bottom surface 26 is curved upwardly and displaced away from the base line 32 that represents the surface of the putting green. There is also shown a sweet spot 34 or point where the ball is preferable struck by the putter 10 and that spot is design to be at a particular location by the maker of the putter 10, however, preferably that sweet spot 34 is vertically located above the base line 32 a distance approximately equal to the radius of a golf ball.

Figure 3:
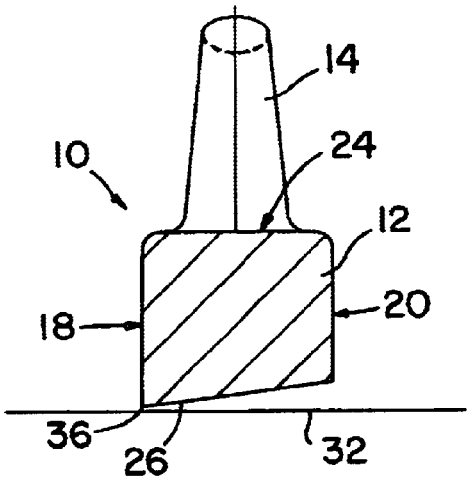
FIG. 3 is a side cross sectional view of the present putter taken along the line 3—3 of FIG. 2.

Turning now to FIG. 3, taken along with FIG. 2, there is shown a side cross sectional view of the putter 10 of the present invention taken along the line 3-3 of FIG. 2. In FIG. 3, it can be seen that the bottom surface 26 slopes upwardly from the front face 18 in the direction toward the back face 20 with the line 32 again representing the surface of the putting green. Accordingly, the back face 20 of the putter head 12 is displaced upwardly from the base line 32 or surface of the green. With the combination of the upwardly sloping bottom surface 26 and the arcuate shape or profile of that bottom surface 26, it can be seen that the front face 18 of the putter determines two outer points 36 (only one of which is shown in FIG. 3) and that the contact with the surface of the putting green, again defined along the line 32, will take place at a two point contact such that even if the golfer does contact the surface of the putting green during the back stroke or the forward stroke, only a minimum of resistance will be encountered and the basic rhythm of the stroke will not be substantially affected.

It will be understood that the scope of the invention is not limited to the particular embodiment disclosed herein, by way of example, but only by the scope of the appended claims.

I claim:

1. A head for a golf putter, said head having a front face adapted to strike a golf ball, a back face formed opposite to said front face and a bottom surface, said front face having a front bottom edge and said back face having a back bottom edge, said front face having an upward arcuate lower surface and said bottom surface of said head being acutely angled upwardly from the front face toward the back face to locate said back bottom edge in a first plane that is vertically disposed above a second plane that contains said front bottom edge so as to minimize the surface of the club head that can encounter the surface of a green during the use of the putter head by contacting the surface of the green only at two points along the front face of the golf putter.

2. A head for a golf putter as defined in claim 1 wherein said front face arcuate lower surface is a concave upwardly surface.

3. A head for a golf putter as defined in claim 1 wherein said front face has outer edges and wherein said putter head initially contacts the surface of a green only at said outer edges during a golf stroke.

4. A golf putter, said golf putter comprising a head, a shaft affixed to said head and extending outwardly therefrom, said head having a front face adapted to strike a golf ball, a back face formed opposite to said front face and a bottom surface, said front face having a lower front edge and said back face having a lower back edge, said front face having an upward arcuate lower surface and said bottom surface of said head being acutely angled upwardly from the front face toward the back face to locate said lower back edge in a first plane that is vertically above a second plane that contains said lower front edge so as to minimize the surface of the club head that can encounter the surface of a green during the use of the putter head by contacting the surface of the green only at two points along the front face of the golf putter.

5. A golf putter as defined in claim 4 wherein said front face arcuate lower surface is a concave upwardly surface.

6. A golf putter as defined in claim 4 wherein said front face has outer edges and wherein said putter head initially contacts the surface of a green only at said outer edges during a golf stroke.

7. A method of manufacturing a golf putter head comprising the steps of:

providing a putter head having a front face, a rear face and a bottom surface, with the front face having a lower front edge and the rear face having a lower rear edge;

shaping the bottom surface so as to be an arcuate profile curving upwardly and inwardly laterally across the front face of the putter head;

shaping the bottom surface so as to acutely slope upwardly in the direction from the front face toward the rear face to locate the lower rear edge in a first plane that is vertically above a second plane that contains said lower front edge.

8. A method of manufacturing a golf club as defined in claim 7 wherein said step of shaping the bottom surface comprises forming a concave surface therein.

9. A method of manufacturing a golf club as defined in claim 7 wherein said step of shaping of the bottom surface provides a bottom surface having contact with a green at two points oppositely located along the front face thereon.

* * * * *